US006611084B2

(12) United States Patent
Teramura et al.

(10) Patent No.: US 6,611,084 B2
(45) Date of Patent: Aug. 26, 2003

(54) SPARK PLUG

(75) Inventors: Hideki Teramura, Mie (JP); Mamoru Musasa, Aichi (JP); Tomoaki Kato, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/082,213

(22) Filed: Feb. 26, 2002

(65) Prior Publication Data

US 2003/0001474 A1 Jan. 2, 2003

(30) Foreign Application Priority Data

Feb. 27, 2001 (JP) ..... 2001-051637

(51) Int. Cl.[7] ..... H01T 13/20; H01T 13/00; F02P 1/00

(52) U.S. Cl. ..... 313/141; 313/11.5; 313/142; 123/169 EL

(58) Field of Search ..... 313/118, 123, 313/127, 130, 131.5, 137, 140–143, 11.5; 123/169 EL

(56) References Cited

U.S. PATENT DOCUMENTS 4,845,400 A * 7/1989 Takamura et al. ..... 313/142
5,239,225 A * 8/1993 Moriya et al. ..... 313/141
5,793,151 A * 8/1998 Kagawa et al. ..... 313/141
6,064,143 A * 5/2000 Kagawa ..... 313/141
6,316,868 B1 * 11/2001 Ishino et al. ..... 313/141

FOREIGN PATENT DOCUMENTS

EP 0774 812 B1 5/1997

* cited by examiner

*Primary Examiner*—Sandra O'Shea
*Assistant Examiner*—Peter Macchiarolo
(74) *Attorney, Agent, or Firm*—Sughrue Mion, PLLC

(57) ABSTRACT

A tip portion of a center electrode 2 of a spark plug includes a tapered portion which is tapered such that the diameter reduces axially frontward. A convex portion 2*k* is formed at an axially intermediate position of the tapered portion so as to project radially outward with respect to an axis 30. The axially measured distance $L_2$ between the vertex of the convex portion 2*k* (the convex vertex P) and the tip face 1D of an insulator is set to less than 0.5 mm. A heat release acceleration metal portion 2*m*, which is made of Cu or an alloy that contains a predominant amount of Cu, is present at a position located a distance $L_3$ of 1.5 mm as measured axially rearward from the convex vertex P in order to suppress spark erosion by lowering the temperature of the center electrode 2. The heat release acceleration metal portion 2*m* is formed such that an electrode base material 2*n*, which encloses the heat release acceleration metal portion 2*m*, has a wall thickness W of not less than 0.6 mm as measured at a position located 1.5 mm axially rearward from the convex vertex P.

5 Claims, 11 Drawing Sheets

SPARK PLUG

BACKGROUND OF THE INVENTION

1. Field of the Invention

The present invention relates to a spark plug for use in an internal combustion engine.

2. Description of the Related Art

A conventional spark plug generally includes a center electrode projecting downward from the tip face of an insulator, and a parallel ground electrode disposed in opposition to the center electrode while one end of the ground electrode is joined to a metallic shell. The spark plug is adapted to ignite an air-fuel mixture by means of spark discharge effected across an air gap between the center electrode and the parallel ground electrode. In addition to such a parallel-electrode spark plug, a creeping-discharge spark plug is known which is a spark plug for use in an internal combustion engine and which features improved fouling resistivity. The creeping-discharge spark plug is configured such that sparks produced in a spark discharge gap creep along the surface of an insulator in the form of creeping discharge at all times or under certain conditions.

For example, a so-called semi-creeping-discharge spark plug includes an insulator having a center through-hole formed therein; a center electrode held in the center through-hole and disposed at a tip portion of the insulator; a metallic shell for holding the insulator such that a tip portion of the insulator projects from the tip face thereof; and a semi-creepage ground electrode disposed such that one end thereof is joined to the metallic shell while the other end thereof faces either the side peripheral surface of the center electrode or the side peripheral surface of the insulator. Creeping discharge involves air discharge effected between the spark face of the semi-creepage ground electrode and the surface of the insulator and sparking that creeps along the tip surface of the insulator. In the spark plug of creeping discharge type, spark discharge occurs so as to creep along the surface of the insulator, thereby continuously burning off fouling and thus exhibiting enhanced fouling resistivity as compared with a spark plug of air discharge.

A hybrid spark plug has been proposed which combines functions of the parallel-electrode type spark plug and the semi-creeping-discharge type spark plug. Since dimensions of the hybrid spark plug are determined such that sparking occurs across a semi-creepage gap even when the tip face of an insulator is not fouled, channeling can be effectively suppressed while fouling resistivity is established, and ignition property can be improved.

Among hybrid spark plugs composed of a parallel ground electrode and a semi-creepage ground electrode, a certain hybrid spark plug includes a heat release acceleration metal portion provided in a center electrode in order to accelerate heat release from the center electrode, the heat release acceleration metal portion being made of a material higher in heat conduction than an electrode base material. As shown in FIG. 10, the heat release acceleration metal portion 2*m* is provided in the interior of the electrode base material so as to accelerate heat release from the entire center electrode, thereby effecting good heat release from the center electrode. The larger the portion of the electrode base material occupied by the heat release acceleration metal, the greater the heat release effect.

3. Problems Solved by the Invention

However, for structural reasons, increasing a portion of the center electrode occupied by the heat release acceleration metal portion unavoidably involves a reduction in the wall thickness of the electrode base material. This potentially results in impaired durability against surface erosion of the electrode base material stemming from spark discharge across a semi-creepage gap.

The hybrid spark plug potentially involves a variation over the course of time in the frequency of sparking across a certain gap depending on engine conditions, engine characteristics, and the like. Dimensions of the hybrid spark plug are determined such that sparking across the semi-creepage gap occurs, even when carbon fouling does not occur as well as when carbon fouling occurs. In the case of such a spark plug involving highly frequent sparking against the side surface of a center electrode, a problem of spark erosion of the side surface of the center electrode arises.

SUMMARY OF THE INVENTION

An object of the present invention is to provide a hybrid spark plug including a parallel ground electrode and a semi-creepage ground electrode, which spark plug exhibits good heat release from a center electrode and excellent durability against spark erosion by effectively protecting a portion of the side peripheral surface of the center electrode subjected to frequent spark impact.

To achieve the above object, the present invention provides a spark plug comprising:

an insulator having a center through-hole formed therein; a center electrode held in the center through-hole, disposed in a tip portion of the insulator, and having a noble metal chip located at a tip portion thereof, a metallic shell for holding the insulator such that a tip portion of the insulator projects from a tip face thereof, a parallel ground electrode disposed such that one end thereof is joined to the tip face of the metallic shell while the other end thereof faces a tip face of the center electrode so as to form a main air gap; and a plurality of semi-creepage ground electrodes each disposed such that one end thereof is joined to the metallic shell while the other end thereof faces at least either the side peripheral surface of the center electrode or the side peripheral surface of the insulator so as to form a semi-creepage gap.

The spark plug is characterized in that a tip portion of the center electrode as projected orthogonally on a virtual plane in parallel with the axis of the center electrode includes a tapered portion which is tapered such that its diameter reduces axially frontward, where the term frontward refers to an axial direction directed into an internal combustion engine; a convex portion is formed at an axially intermediate position of the tapered portion such that an outline thereof as viewed on the virtual plane projects radially outward with respect to the axis; the axially measured distance between the vertex of the convex portion (hereinafter may be called the convex vertex) and the tip of the insulator is less than 0.5 mm; a heat release acceleration metal portion higher in thermal conductivity and linear expansion coefficient than an electrode base material, which forms a surface layer portion of the center electrode, is present at a position located 1.5 mm axially rearward from the convex vertex while being enclosed by the electrode base material; and the heat release acceleration metal portion is formed such that the electrode base material has a wall thickness of not less than 0.6 mm as measured at a position located 1.5 mm axially rearward from the convex vertex.

As described above, the center electrode has a convex portion formed such that the axially measured distance between the convex vertex and the tip face of the insulator is less than 0.5 mm, thereby yielding the following effect: sparks which creep along the tip surface of the insulator can readily reach the convex vertex, which is angular and on which an electric field concentrates, thereby maintaining good ignition property at a gap between the semi-creepage ground electrode and the center electrode. Since sparks generated between the electrodes creep along the tip face of the insulator, the sparks erode, for example, a portion of the center electrode located rearward of the convex vertex, such as the region C in FIG. 10.

Thus, by employing the above-described configuration in which the heat release acceleration metal portion is present at a position located 1.5 mm axially rearward from the vertex of the convex portion of the center electrode having the noble metal chip located at the tip portion, the heat release acceleration metal portion suppresses an increase in electrode temperature. Additionally, by imparting to the electrode base material a wall thickness of not less than 0.6 mm as measured at a position located 1.5 mm axially rearward from the convex vertex, the electrode base material becomes sufficiently thick to withstand progress of erosion associated with spark discharge across a semi-creepage gap, thereby contributing to maintenance of spark plug performance over a long period of time. The heat release acceleration metal portion is higher in thermal conductivity and linear expansion coefficient than the electrode base material. Such a combination of the electrode base material and the heat release acceleration metal portion, which are made of different materials, potentially involves a burst phenomenon in which, when the electrode base material becomes thin as a result of progress of erosion, the difference in thermal shrinkage causes the heat acceleration metal portion to burst out of the electrode base metal before being exposed as a result of erosion. The burst phenomenon can be prevented, as mentioned above, by imparting a sufficient wall thickness to a portion of the electrode base material which is potentially eroded.

In addition to the above-described configuration, the heat release acceleration metal portion may be formed within the center electrode at a position located less than 1.5 mm as measured axially from the tip of the electrode base material located on the spark gap side. As compared to the case of the prior art configuration shown in FIG. 10, such frontward extension of the heat release acceleration metal portion allows an increase in the wall thickness of the electrode base material while the percentage of the heat release acceleration metal portion to the center electrode is held unchanged. Also, the heat release acceleration metal portion is disposed throughout the center electrode, thereby effectively enhancing heat release from the entire center electrode.

Preferably, the above-described spark plug employs the following structural features: a spark erosion resistant metal portion formed of a metal higher in spark erosion resistivity than the electrode base material is formed on the surface of the center electrode in opposition to the semi-creepage ground electrodes; and the axially rearward end of the spark erosion resistant metal portion is located axially frontward of the position located 1.5 mm axially rearward from the convex vertex.

The spark erosion resistant metal portion disposed at a portion of the surface of the center electrode which faces the semi-creepage ground electrode and is potentially eroded by sparks effectively suppresses spark erosion of the surface portion, whereby the spark plug exhibits excellent durability.

In this case, preferably, the spark erosion resistant metal portion formed of a metal higher in spark erosion resistivity than the electrode base material is formed at a portion of the surface of the center electrode which faces the semi-creepage ground electrode and is located axially rearward of the convex vertex; i.e., is located so as not to extend across the convex vertex.

The spark erosion resistant metal portion is disposed so as not to extend across the convex vertex such that the electrode base material which contains a component to suppress spark discharge erosion of the insulator extends across the convex vertex; i.e., such that the electrode base material forms the convex portion. By employing this configuration, a portion of the center electrode located axially rearward of the convex portion is protected by means of the spark erosion resistant metal portion, while in the vicinity of the convex portion sparks collide against the base material of the center electrode, so that the base material of the center electrode scatters. The thus-scattered erosion suppression component contained in the base material of the center electrode adheres to the tip of the insulator. Accordingly, this configuration provides a synergistic effect in that spark erosion of the side peripheral surface of the center electrode is suppressed while channeling is suppressed.

Specifically, for example, the spark erosion resistant metal portion is preferably formed such that the axially frontward end thereof is located axially frontward of a position located 0.5 mm axially rearward from the tip of the insulator. If the spark erosion resistant metal portion is disposed such that the axially frontward end thereof is located axially rearward of the above position, the spark erosion resistant metal portion deviates greatly from a position which is likely to be exposed to sparks, thus failing to yield the effect of suppressing spark erosion of the electrode.

In the above-described spark plug, the insulator may be radiused or chamfered at the opening edge of the center through-hole on the tip face thereof. When the convex vertex is located axially rearward of the tip of the insulator, at the time of semi-creeping discharge, sparks are generated between the semi-creepage ground electrode and the convex vertex via the opening edge of the center through-hole. If the opening edge is not radiused or chamfered, sparks generated via the opening edge cause channeling. Once channeling occurs, spark generation concentrates at a position where channeling occurs; as a result, the intensity of channeling tends to increase. Radiusing or chamfering the opening edge effectively suppresses occurrence of channeling. Preferably, radiusing or chamfering is performed at a radius of curvature of or at a width of 0.05 mm to 0.4 mm.

Figure 1:
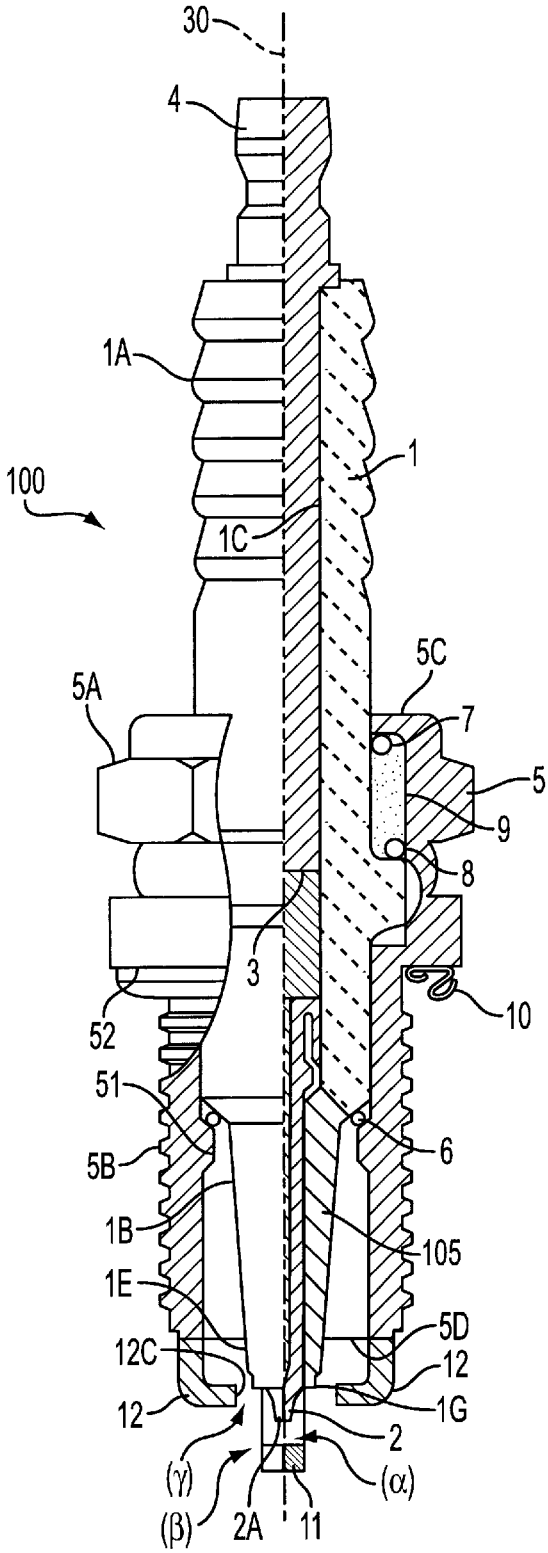
FIG. 1 is a partial sectional view showing a spark plug according to an embodiment of the present invention.

Reference numerals are used to identify items shown in the drawings as follows:

1: insulator

1D: tip face of insulator

1E: side peripheral surface of insulator

1G: chamfering

1J: radiusing

2: center electrode

2*k*: convex portion

2*n*: electrode base material

2*m*: heat release acceleration metal portion

5: metallic shell

11: parallel ground electrode

12: semi-creepage ground electrode

30: center axis (α): main air gap (β): semi-creepage gap (γ): semi-creepage insulator gap P: convex vertex

DESCRIPTION OF THE PREFERRED EMBODIMENTS

Embodiments of the present invention will next be described with reference to the drawings. However, the present invention should not be construed as being limited thereto.

FIG. 1 is a partial sectional view showing a spark plug 100 according to an embodiment of the present invention. As well known, an insulator 1 formed of alumina or the like includes corrugations 1A provided at a rear end portion thereof for increasing creepage distance; a leg portion 1B exposed to a combustion chamber of an internal combustion engine; and a center through-hole 1C formed along the center axis, an opening portion thereof on the tip face being chamfered as indicated by reference numeral 1G (see FIGS. 4, 6, 7, and 8). The center through-hole 1C holds therein a center electrode 2. When the center electrode 2 employs a noble metal chip, at least a surface layer portion of the center electrode 2 is formed of an electrode base material 2*n* composed of, in mass percentage, iron: 6–20%; chromium: 14–25%; impurities: not greater than 3%; aluminum as needed: 1–2%; and balance: a nickel alloy containing at least 58% nickel, or a like alloy. Examples of the electrode base material 2*n* include INCONEL (trade name) 600 or 601. The center electrode 2 is provided so as to project from the tip face of the insulator 1.

The center electrode 2 is electrically connected to an upper metallic terminal member 4 via a ceramic resistor 3 provided within the center through-hole 1C. An unillustrated high-voltage cable is connected to the metallic terminal member 4 so as to apply high voltage to the metallic terminal member 4. The insulator 1 is enclosed by a metallic shell 5 and supported by a retaining portion 51 and a crimped portion 5C of the metallic shell 5. The metallic shell 5 is made of low-carbon steel and includes a tool engagement portion (hexagonal portion) 5A to be engaged with a spark-plug wrench, and a male-threaded portion 5B of a nominal size of, for example, M14S. The metallic shell 5 is crimped to the insulator 1 by means of the crimped portion 5C, whereby the metallic shell 5 and the insulator 1 are united. In order to complement the hermetic seal effected by crimping, a sheetlike packing member 6 and a wirelike sealing members 7 and 8 are interposed between the metallic shell 5 and the insulator 1. A space provided between the sealing members 7 and 8 is filled with a powdered talc 9. A gasket 10 rests on the rear end of the male-threaded portion 5B; i.e., on a seat 52 of the metallic shell 5.

A parallel ground electrode 11 is welded to a tip face 5D of the metallic shell 5. A base material of the parallel ground electrode 11 is a nickel alloy, and at least a surface layer portion of the parallel ground electrode 11 is formed of the base material. The parallel ground electrode 11 axially faces the tip face of the center electrode 2 to thereby form a main air gap (α) therebetween. For example, the side-to-side dimension of the hexagonal portion 5A is 16 mm, and the length between the seat 52 and the tip face 5D of the metallic shell 5 is set to 19 mm. The set dimension is a standard dimension of a spark plug having a small hexagonal size of 14 mm and a dimension A of 19 mm as prescribed in JIS B 8031 (1995). In order to lower the temperature of a tip portion for suppressing spark erosion, a material of good heat conduction (e.g., Cu, pure Ni, or a composite material thereof) higher in thermal conductivity than the base material may be provided within the parallel ground electrode 11. The above-mentioned configuration is similar to that of a conventional spark plug.

The spark plug 100 according to the present embodiment includes a plurality of semi-creepage ground electrodes 12 in addition to the parallel ground electrode 11. Each of the semi-creepage ground electrodes 12 is configured such that a base material thereof is a nickel alloy; at least a surface layer portion is formed of the base material; one end is welded to the tip face 5D of the metallic shell 5; and an end face 12C of the other end faces either a side peripheral surface 2A of the center electrode 2 or a side peripheral surface 1E of the leg portion 1B. As shown in the bottom view of FIG. 3, two semi-creepage ground electrodes 12 are circumferentially shifted by 90° from the parallel ground electrode 11 while being circumferentially shifted by substantially 180° from each other.

Figure 2:
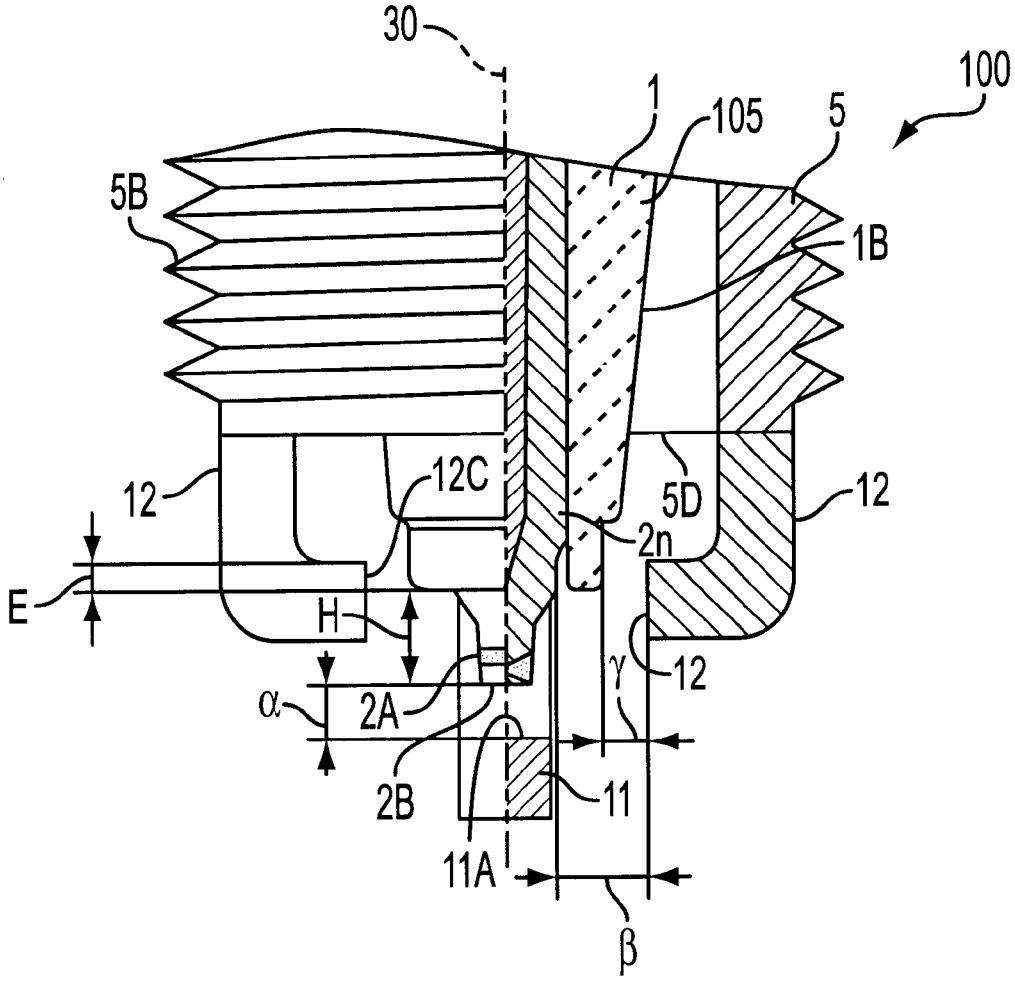
FIG. 2 is an enlarged partial sectional view showing electrodes and their peripheral regions of the spark plug of FIG. 1.
Figure 3:
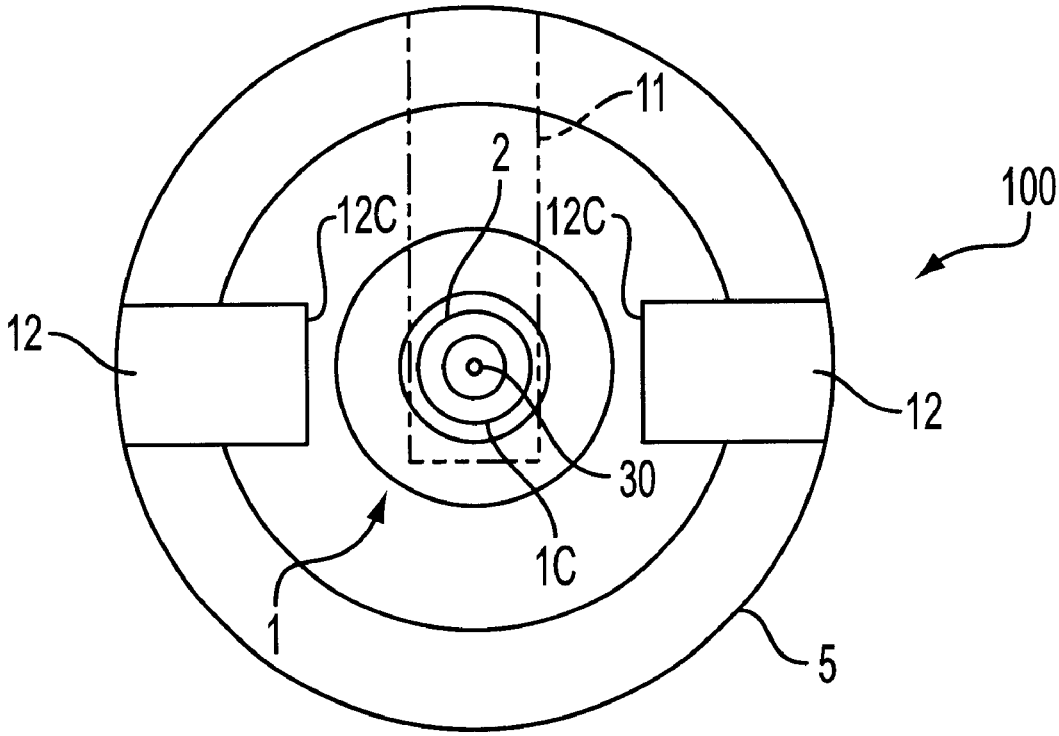
FIG. 3 is a bottom view of the spark plug of FIG. 2.

FIG. 3 shows a state in which a tip portion of the insulator 1 is viewed from the front side along an axis 30. The end face 12C of each semi-creepage ground electrode 12 has a width greater than the diameter of an opening of the center through-hole 1C at the tip face of the insulator 1. As shown in FIG. 2, a predetermined gap β, which serves as a semi-creepage gap (β) in FIG. 1, is formed between the end face 12C of each semi-creepage ground electrode 12 and the side peripheral surface 2A of the center electrode 2; and a predetermined gap γ, which serves as a semi-creepage insulator gap (γ) in FIG. 1, is formed between the end face 12C of each semi-creepage ground electrode 12 and the side peripheral surface 1E of the leg portion 1B. Also, a gap α, which serves as the main air gap (α), is formed between a side face 11A of the parallel ground electrode 11, which side face 11 faces the center electrode 2, and a front tip face 2B of the center electrode 2. Furthermore, a distance H (hereinafter, may be called a "projection amount H") between the tip face 2B of the center electrode 2, which tip face 2B projects frontward from the tip of the insulator 1, and the tip of the insulator 1 is set to a predetermined value.

The axial distance between the tip face of the insulator 1 and the axially rear edge of the end face 12C of the semi-creepage ground electrode is set to a predetermined distance E mm. These α, β, γ, E, and H values may be set according to the following relations. By employing the relation 0.7 mm≦α (mm)≦(0.8 (β−γ)+γ) (mm), spark discharge can be caused to occur across the semi-creepage gap at a predetermined frequency during normal operation. The β, γ, E, and H values are adjusted so as to satisfy the following relations: β (mm)≦2.2 mm; 0.4 mm≦γ (mm)≦(α−0.1) (mm); E (mm)≦0.5 mm; and 1.0 mm≦H (mm)≦4.0 mm.

By employing the relations β≦2.2 mm and 0.4 mm≦γ (mm)≦(α−0.1) (mm), when the surface of the insulator enters a "carbon fouling" state, semi-creeping discharge can be caused to more reliably occur between the semi-creepage ground electrode and the center electrode. When the distance β of the semi-creepage gap is greater than 2.2 mm, there increases the probability that discharge does not occur between the semi-creepage ground electrode and the center electrode, whereas discharge occurs between the center electrode and a portion of the metallic shell in the vicinity of an insulator mounting portion, along the surface of the leg portion of the insulator; i.e., the probability that so-called flashover occurs. When the distance γ of the semi-creepage insulator gap (γ) is less than 0.4 mm, a bridge of carbon is formed between the semi-creepage ground electrode and the insulator, thereby increasing the probability that discharge is disabled.

When the distance γ of the semi-creepage insulator gap (γ) becomes greater than the distance α of the main air gap (α) minus 0.1 mm, even in a "carbon fouling" state, there increases the probability that discharge occurs across the main air gap (α) between the parallel ground electrode and the center electrode rather than discharge occurring across the semi-creepage gap (γ) between the semi-creepage ground electrode and the center electrode.

When E is not greater than +0.5 (E≦+0.5; the sign + indicates the direction in which the lower edge of the end face of the semi-creepage ground electrode moves away frontward from the tip face of the insulator), a spark cleaning action for cleaning the surface of the insulator by means of sparks of semi-creeping discharge can be effectively maintained. When the E value is greater than +0.5 mm, sparks of semi-creeping discharge do not stick to the tip face of the insulator, thereby lessening the effect of a spark cleaning action for cleaning the insulator surface.

When H is not less than 1.0 mm and not greater than 4.0 mm (1.0 mm≦H≦4.0 mm), the erosion of the center electrode caused by semi-creeping discharge can be suppressed. Furthermore, the difference can be reduced between ignition property associated with spark discharge across the main air gap (α) between the parallel ground electrode and the center electrode and that associated with semi-creeping discharge induced by the semi-creepage ground electrode, thereby suppressing torque variations of an internal combustion engine which arise from a change in ignition property that accompanies a change in the discharge electrodes. When the projection amount H of the center electrode is less than 1.0 mm, the erosion of the side peripheral surface of the center electrode increases.

When the projection amount H of the center electrode is greater than 4.0 mm, ignition property associated with semi-creeping discharge is impaired as compared to that associated with the main air gap (α), resulting in an increased difference in ignition property therebetween. Also, the temperature of the center electrode becomes too high, causing an increase in the probability that preignition arises.

In FIG. 3, the end face 12C of the semi-creepage ground electrode 12 is formed flat. However, in order to form a substantially uniform semi-creepage gap along the side peripheral surface of the insulator 2, the end face 12C may be formed into a cylindrical shape while the axis 30 of the insulator 2 serves as the center of the cylindrical shape, through, for example, blanking.

As in the case of the parallel ground electrode 11, a material of good heat conduction, such as Cu, pure Ni, or a composite material thereof, may be provided within the semi-creepage ground electrode 12. In this case, the semi-creepage ground electrode 12 includes a surface layer portion formed of a base material and an inner layer portion formed of a material of good heat conduction (e.g., Cu, pure Ni, or a composite material thereof) higher in thermal conductivity than the base material.

Figure 4A:
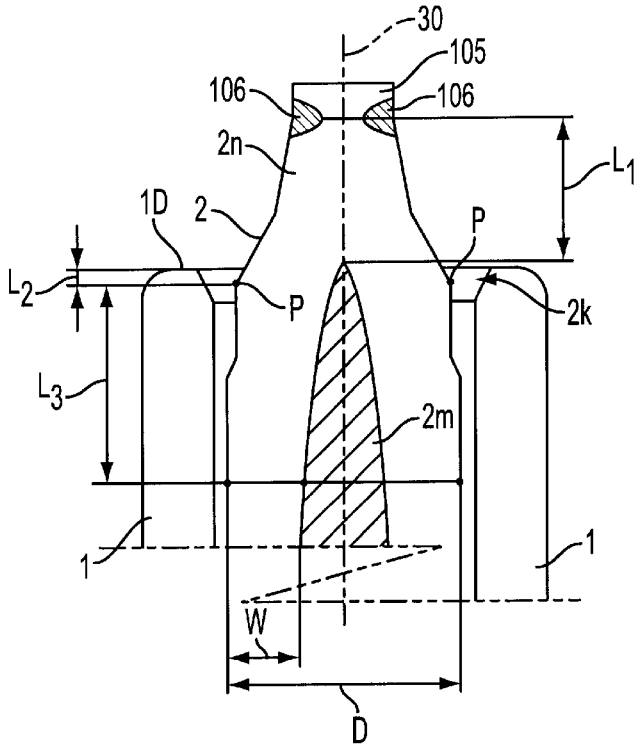
FIGS. 4(*a*) and 4(*b*) are conceptual views showing an orthogonally projected image on a virtual plane parallel with the axis of the center electrode.
Figure 4B:
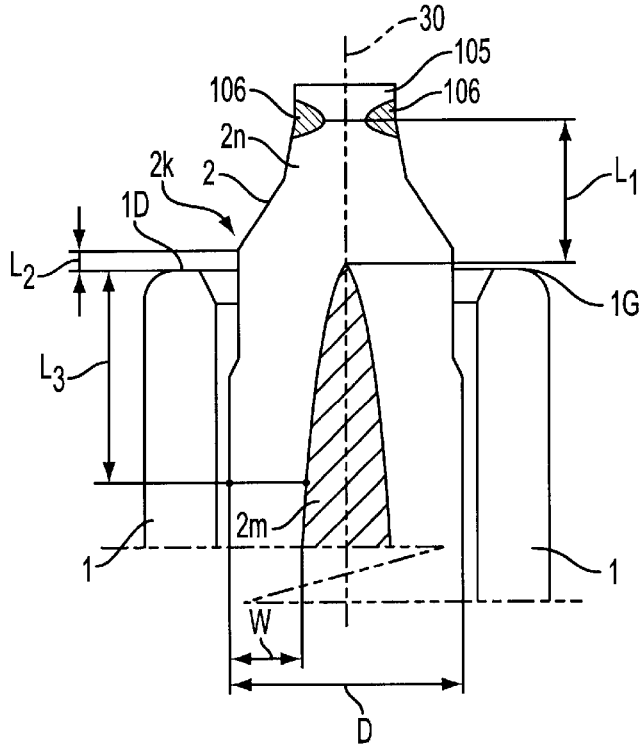

FIG. 4 shows the insulator 1 and the center electrode 2 projected orthogonally on a virtual plane in parallel with the axis 30 of the center electrode 2 in order to explain the dimensional and positional relations among structural features of the insulator 1 and the center electrode 2. As shown in FIG. 4, a tip portion of the center electrode 2 includes a tapered portion which is tapered such that the diameter reduces axially frontward; and a convex portion 2*k* is formed at an intermediate position along the axis 30 of the tapered portion so as to project radially outward with respect to the axis 30. FIG. 4(*a*) shows a configuration in which a vertex P of the convex portion 2*k* (hereinafter may be called a convex vertex P) is located axially rearward of an insulator tip face 1D. FIG. 4(*b*) shows a configuration in which the convex vertex P is located axially frontward of the insulator tip face 1D. The axially measured distance L2 between the convex vertex P and an insulator tip (in FIG. 4(*a*), the distance between the convex vertex P and the insulator tip face 1D) is set to less than 0.5 mm.

When the term frontward refers to an axial direction directed to an internal combustion engine, a heat release acceleration metal portion 2*m* is present at a position located a distance $L_3$ of 1.5 mm measured axially rearward from the convex vertex P in order to suppress spark erosion by lowering the temperature of the center electrode 2. The heat release acceleration metal portion 2*m* is formed such that the electrode base material 2*n*, which encloses the heat release acceleration metal portion 2*m* and forms a surface layer portion of the center electrode 2, has a wall thickness W of not less than 0.6 mm measured at the position corresponding to the distance $L_3$ of 1.5 mm. When the wall thickness W is in excess of 2D/5 mm (where D is the outside diameter of the center electrode 2 as measured at the position corresponding to $L_3$=1.5 mm (see FIG. 4)), the spark plug encounters difficulty in reducing the size thereof. Thus, preferably, the wall thickness W is not greater than 2D/5 mm (W≦2D/5 mm). The heat release acceleration metal portion 2*m* can be made of a material higher in thermal conductivity than the electrode base material 2*n*. For example, the heat release acceleration metal portion can be made of Cu or an alloy that contains a predominant amount of Cu.

The heat release acceleration metal portion 2*m* is formed so as to extend through the center electrode 2 and to reach the spark-gap-side tip of the electrode base material 2*n* along the axial direction or such that the heat release acceleration metal portion 2*m* does not reach the spark-gap-side tip but reaches an axial position located less than 1.5 mm from the spark-gap-side tip. In other words, the distance $L_1$ between the axial tip of the heat release metal portion 2*m* and the axial tip of the electrode base metal 2*n* is set to 0 mm ($L_1$=0 mm; i.e., the tip positions coincide with each other) or to greater than 0 mm and not greater than 1.5 mm (0 mm<$L_1$≦1.5 mm). Preferably, $L_1$ is less than 1.0 mm while falling within the above range.

The heat release acceleration metal 2*m* can be configured such that the width of its outline as projected on the above-mentioned virtual plane (a width direction is perpendicular to the axis) narrows toward a center electrode tip. In the present embodiment, the frontward tip of the heat release acceleration metal portion 2*m* is acute. Such a structural feature allows the heat release acceleration metal portion 2*m* to be disposed even in a tapered tip portion of the center electrode 2 while maintaining the wall thickness of the electrode base material 2*n*. The present embodiment is configured such that the heat release acceleration metal portion 2*m* is present on the axially frontward side of the convex vertex P and extends axially rearward.

Figure 5A:
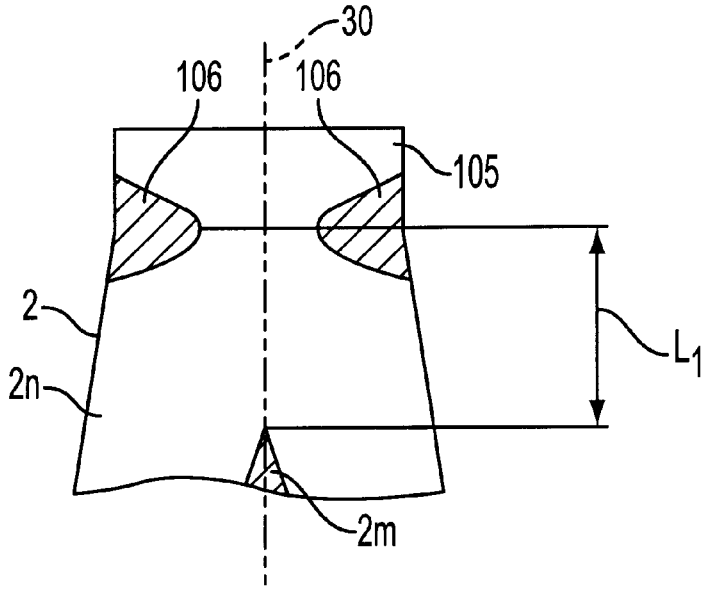
FIGS. 5(*a*) and 5(*b*) show views for explaining the definition of a tip position of an electrode base material.
Figure 5B:
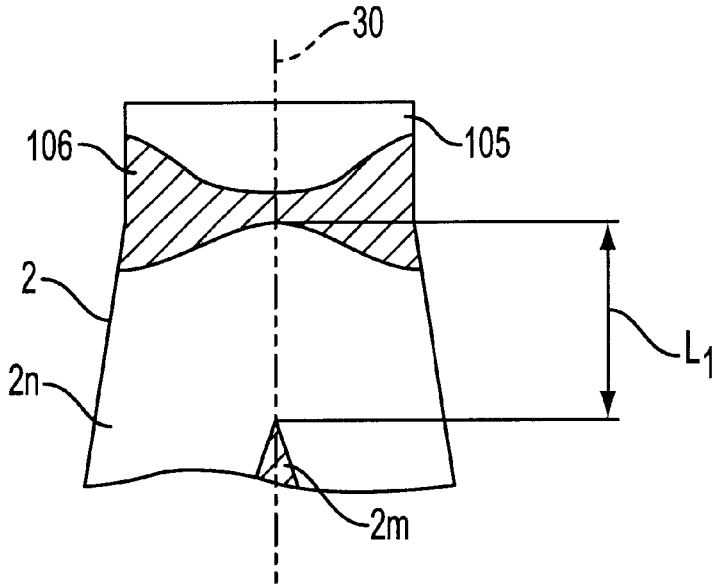

In the present invention, as shown in FIG. 5(*a*), when an electrode chip 105 made of noble metal or the like is integrally joined to the spark-gap-side tip of the electrode base material 2*n* by means of welding or a like process, the boundary between the electrode chip 105 and the electrode base material 2 which intersects the axis 30 is defined as the spark-gap-side tip. As shown in FIG. 5(*b*), when a fusion zone 106 resulting from welding is present between the electrode base material 2*n* and the electrode chip 105, the intersection of the axis 30 and the tip of the electrode base material 2*n* merging into the fusion zone 106; i.e., the intersection of the axis 30 and the boundary between the fusion zone 106 and the electrode base material 2*n* is defined as the position of the electrode base material tip. The tip of the heat release acceleration metal portion 2*m* is defined as a most axially frontward position which the projecting heat release acceleration metal portion 2*m* reaches.

Figure 6:
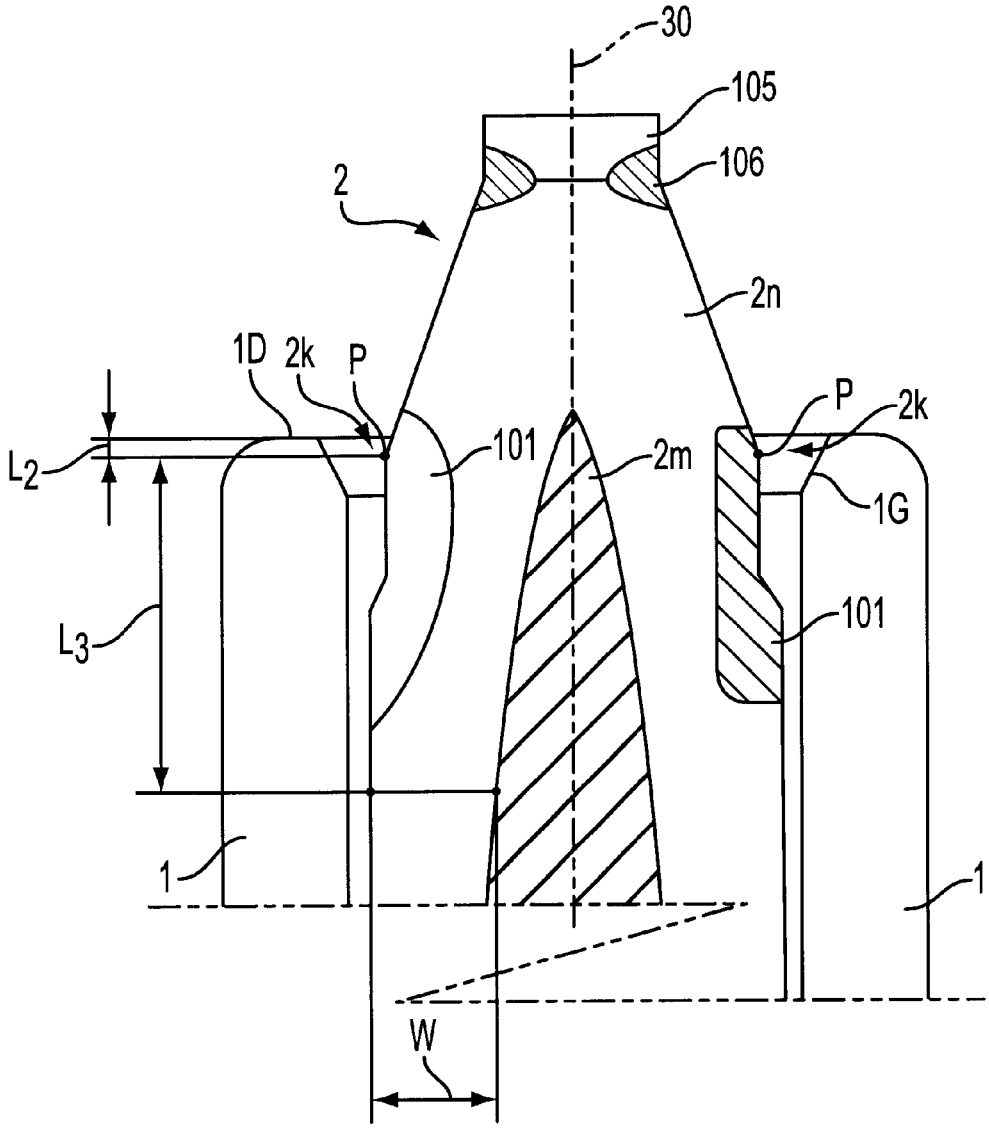
FIG. 6 is a conceptual view showing an orthogonally projected image on a virtual plane parallel with the axis of the center electrode.

FIG. 6 shows an example in which a spark erosion resistant metal portion 101 is formed at a position located axially rearward of the convex vertex P and at a surface layer portion (including the side peripheral surface 2A (FIG. 2)) of the center electrode 2 located less than 0.5 mm axially rearward from the axially frontward tip (the tip face 1D in the example of FIG. 6) of the insulator 1. The spark erosion resistant metal portion 101 includes the convex portion 2*k* and extends axially across the convex vertex P. Specifically, axial ends of the spark erosion resistant metal portion 101 are located on opposite sides with respect to the convex vertex P. Also, the spark erosion resistant metal portion 101 is formed such that the axially rearward end thereof is located axially frontward of a position located 1.5 mm axially rearward from the convex vertex. An end of the spark erosion resistant metal portion 101 means the following boundary: when the spark erosion resistant metal portion is formed of a noble metal or a noble metal alloy, the boundary between a region containing the noble metal component in an amount of not less than 50% by mass and a region containing the noble metal component in an amount of less than 50%; and when the spark erosion resistant metal portion is formed of a metal having an Ni content of not less than 90% by mass, which will be described below, the boundary between a region of an Ni content of not less than 90% by mass and a region of an Ni content of less than 90%.

Specifically, the noble metal can be a metal which contains at least any one of, for example, Ir, Pt, Rh, Ru, and Re in a predominant amount, or a composite material which contains a predominant amount of the metal. In place of containing a predominant amount of the noble metal, the spark erosion resistant metal portion may be formed of a metal of an Ni content of not less than 90% by mass. By employing these metals, the spark erosion resistant metal portion 101 exhibits excellent heat resistance and corrosion resistance; thus, the erosion of the spark erosion resistant metal portion 101 can be suppressed, thereby enhancing the durability of the spark plug 100 (FIG. 1). Also, there accrue the following advantages: a re-adhering phenomenon (may also be called perspiration) in which molten splashes of material re-adhere to a spark plug during discharge is unlikely to occur; and a spark discharge gap is unlikely to suffer a short-circuiting phenomenon (so-called bridging) which would otherwise result from such adhering material.

Figure 7:
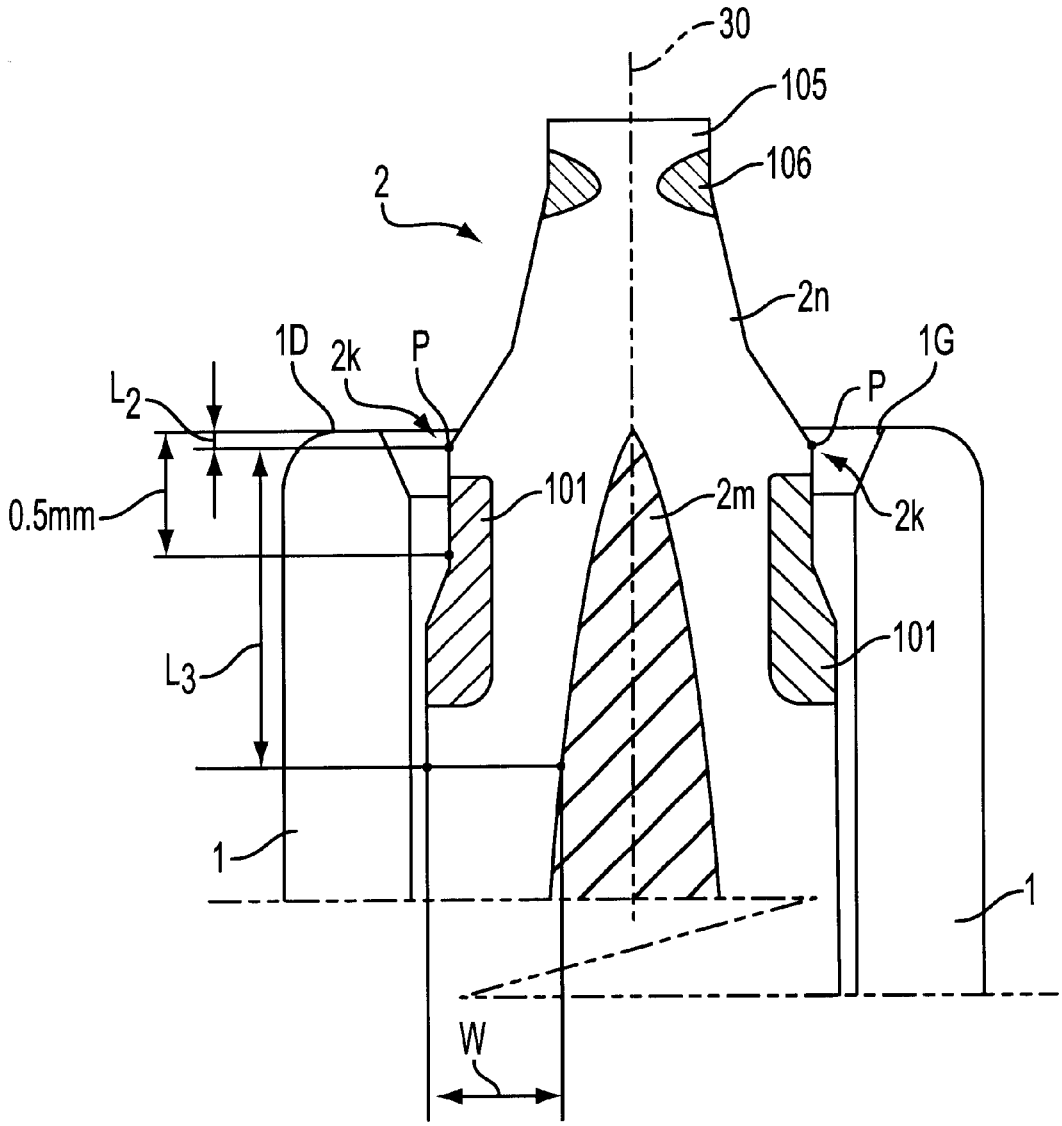
FIG. 7 is a conceptual view showing an orthogonally projected image on a virtual plane parallel with the axis of the center electrode.

FIG. 7 shows an example in which the spark erosion resistant metal portion 101 is formed at a position located axially rearward of the convex vertex P and at a center-electrode surface layer portion located less than 0.5 mm axially rearward from the axially frontward tip (the tip face 1D in the example of FIG. 7) of the insulator 1. Specifically, the spark erosion resistant metal portion 101 is formed such that the axially frontward end thereof is located less than 0.5 mm axially rearward from the axially frontward tip (the tip face 1D) of the insulator 1. Also, the spark erosion resistant metal portion 101 is formed such that the axially rearward end thereof is located axially frontward of a position located 1.5 mm axially rearward from the convex vertex.

When the spark erosion resistant metal portion 101 is positioned such that the axially frontward end thereof is located less than 0.5 mm axially rearward from the tip of the insulator 1, creeping-discharge sparks impinge on the spark erosion resistant metal portion 101 more efficiently, thereby suppressing electrode erosion very effectively. When the frontward end of the spark erosion resistant metal portion 101 is retreated in excess of 0.5 mm rearward, the spark erosion resistant metal portion 101 greatly deviates from a position which is to be exposed to sparks, and thus becomes unlikely to contribute to suppression of electrode erosion.

In FIG. 7, the spark erosion resistant metal portion 101 formed on the outer peripheral surface of the center electrode 2 does not extend across the convex vertex P in the axial direction of the center electrode 2. Specifically, the spark erosion resistant metal portion 101 is disposed such that the convex portion 2*k*—which is formed of a metal material serving as the electrode base material 2*n* of the center electrode 2 containing iron and chromium, which are components for forming an erosion suppression layer—is located opposite the tip (the tip face 1D) of the insulator 1. Thus, upon generation of creeping-discharge sparks, the sparks impinge on the surface of the metal material (the surface of the electrode base material 2*n*) with a certain frequency. The impinging sparks cause the splashing of the metal material, thereby supplying the components for forming an erosion suppression layer and thus accelerating the formation of an erosion suppression layer. Accordingly, a channeling prevention effect is enhanced. Since, as described above, the spark erosion resistant metal portion 101 protects a region on which sparks impinge with great frequency, impingement of sparks on the convex portion 2*k* is allowed to an extent corresponding to the above-mentioned yield of the channeling prevention effect while electrode erosion is minimized.

Figure 8A:
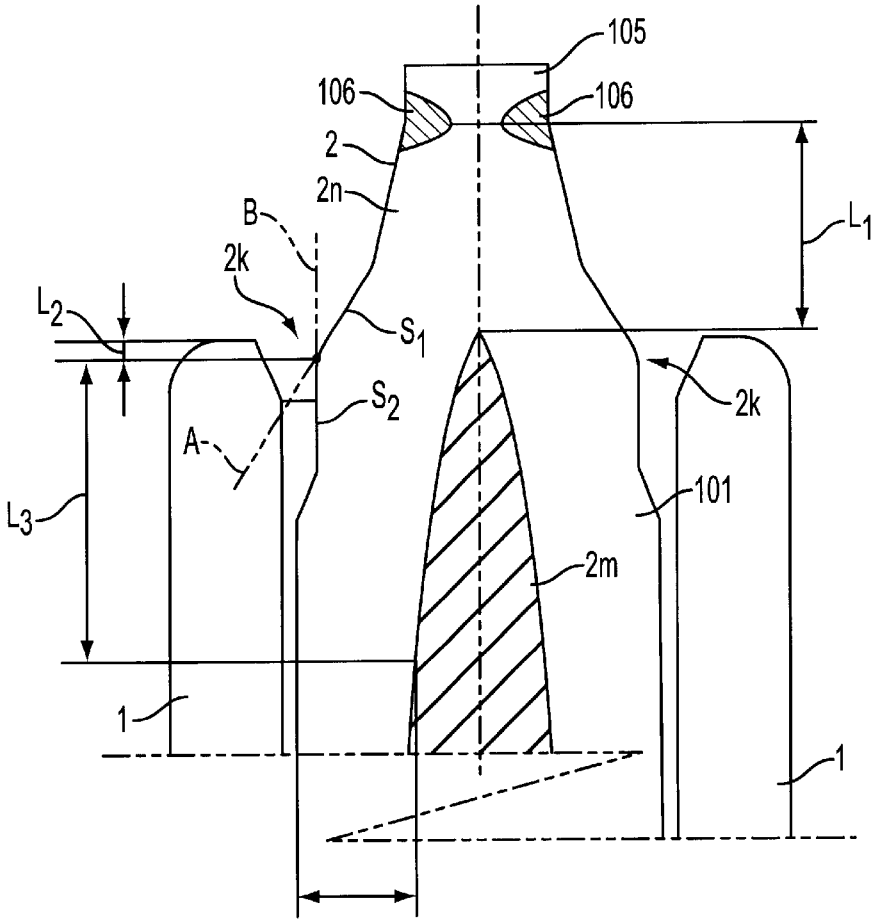
FIGS. 8(*a*) and 8(*b*) are sectional views showing essential portions of a spark plug having a curved convex portion.
Figure 8B:
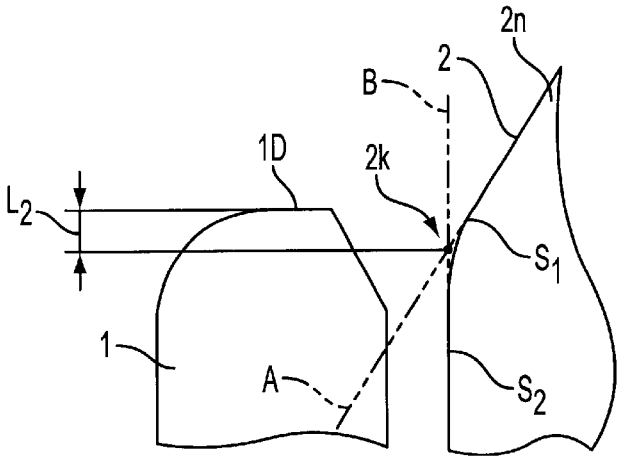
Figure 9:
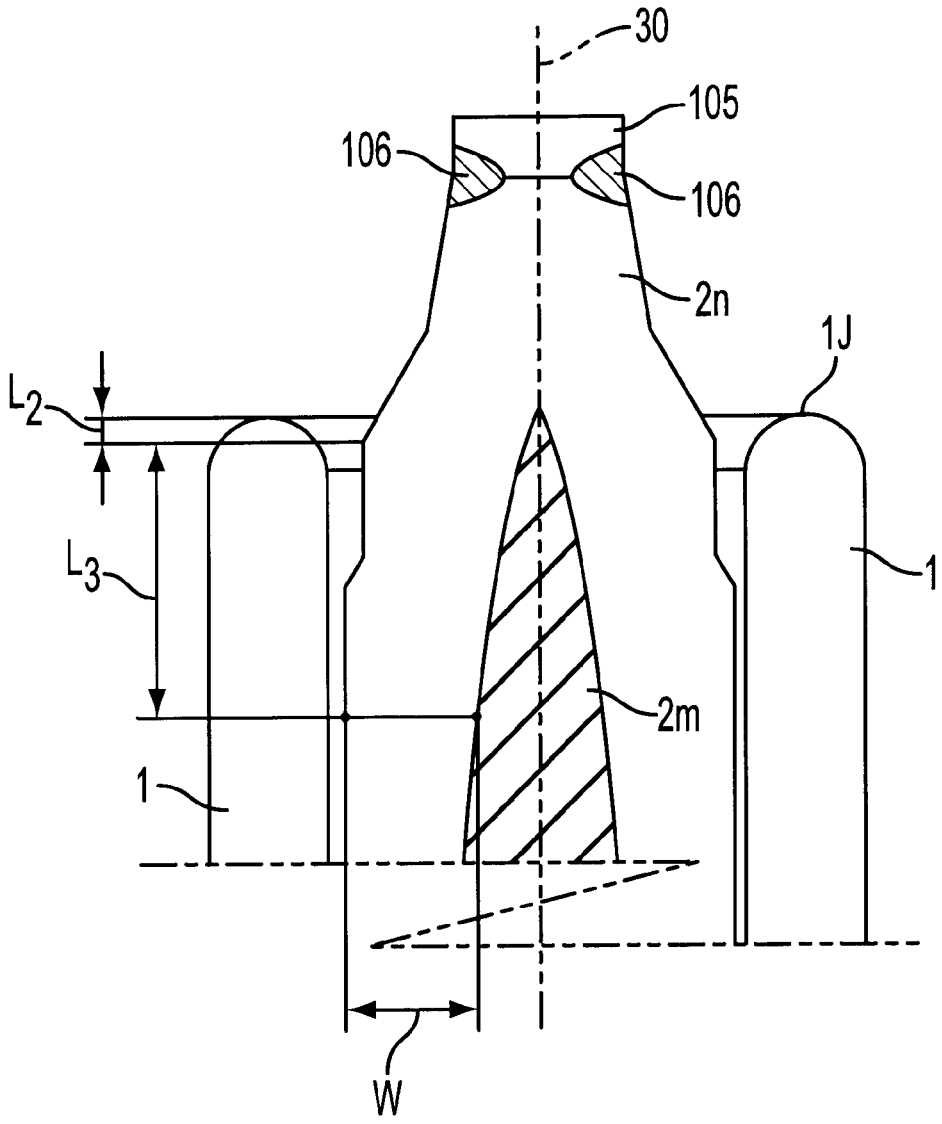
FIG. 9 is a view for explaining the definition of a tip position of an insulator having a curved tip.
Figure 10:
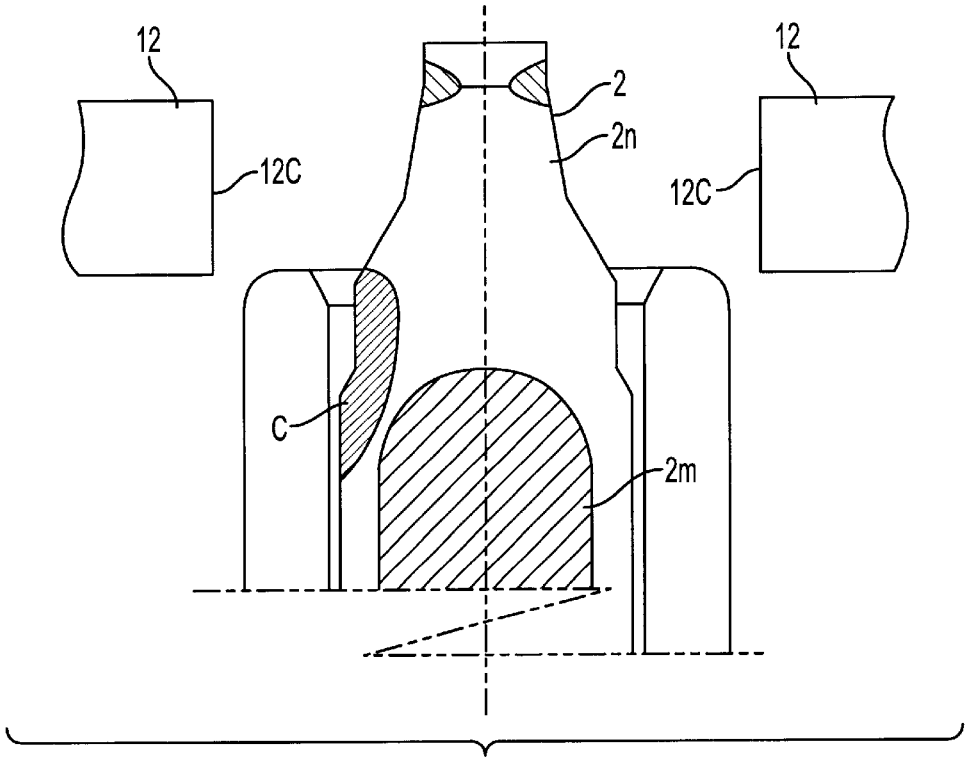
FIG. 10 (PRIOR ART)
FIG. 10 is a view showing an example of a conventional spark plug.

In the spark plug of the present invention in which the outline of the convex portion 2*k* shown in the orthogonally projected image of FIG. 8 curves continuously, the convex vertex P is defined as follows. As shown in the enlarged view of FIG. 8(*b*), the outlines of straight line portions $S_1$ and $S_2$ located at opposite sides of the curved convex portion 2*k* are extended to make extension lines A and B. The intersection of the extension lines A and B is defined as the convex vertex P. The distance between the convex vertex P and the insulator tip is set to fall within the above-mentioned range. As shown in the orthogonally projected image of FIG. 9, when, in the present invention, the outline of the insulator tip face is not a straight line perpendicular to the axis 30, an axially most frontward position on the outline of the insulator is defined as the insulator tip, which is used in the above-described adjustment of ranges. The above-described range settings are similarly applicable to the configuration of FIG. 4(*a*) in which the convex vertex P is located rearward of the insulator tip and the configuration of FIG. 4(*b*) in which the convex vertex P is located frontward of the insulator tip. The opening edge of the center through-hole on the tip face 1D is radiused as denoted by reference numeral 1J.

EXAMPLES

In order to confirm the effects of the present invention with respect to the above-described spark plug, the following experiments were carried out. The spark plug used in these experiments was similar to the spark plug of FIG. 2, except that only a single semi-creepage ground electrode was employed. Specifically, the spark plug used in the experiments was configured such that the parallel ground electrode 11 and one of the two semi-creepage ground electrodes 12 are removed from the spark plug of FIG. 2. In the spark plug used in the experiments, the gap γ of the semi-creepage insulator gap (γ) was set to 0.5 mm, and the gap γ (the distance between the convex vertex P and the semi-creepage ground electrode end face) of the semi-creepage gap (β) was set to 1.5 mm. The distance L2 between the convex vertex P and the insulator tip face 1D was set to 0.2 mm. INCONEL 600 was used as an electrode base material for the center electrode 2 and the ground electrode 4. The thus-dimensionally-adjusted spark plugs were prepared such that the wall thickness of the electrode base material as measured at a position located 1.5 mm axially rearward from the convex vertex was varied at intervals of 0.1 mm over a range of 0.3 mm to 0.7 mm.

The thus-prepared spark plugs were subjected to a thermal cycle test which was carried out for 200 hours in cycles each consisting of one-minute operation at an engine speed of 5000 rpm with the throttle fully opened, and one-minute idling. The tested spark plugs were visually checked for exposure of the heat release acceleration metal portion. Test results are shown in Table 1. In Table 1, the mark X indicates that the heat release acceleration metal portion was exposed; and the mark O indicates that the heat release acceleration metal portion was not exposed.

TABLE 1

| Wall thickness (mm) | 0.3 | 0.4 | 0.5 | 0.6 | 0.7 |
|---|---|---|---|---|---|
| Test results | X | X | X | O | O |

As shown in Table 1, exposure of the heat release acceleration metal portion was not observed with the spark plugs in which the wall thickness of the electrode base material measured at a position located 1.5 mm rearward was not less than 0.6 mm, whereas exposure of the heat release acceleration metal portion was observed with the spark plugs in which the wall thickness was less than 0.6 mm. The thermal cycle test results reveal that a high erosion resistant effect is obtained by imparting to the electrode base material a wall thickness of not less than 0.6 mm measured at a position located 1.5 mm axially inward.

As another example, a spark plug which is configured as shown in FIGS. 6 and 7 and has two semi-creepage ground electrodes 12 was fabricated while being dimensionally set as follows: main air gap (α):α=1.1 mm; each semi-creepage insulator gap (γ):γ=0.5 mm; each semi-creepage gap (β):β=1.5 mm; projection amount: H=1.5 mm; and axial distance between tip face of insulator and axially rear edge of end face of each semi-creepage ground electrode: E=0.2 mm. (Symbols α, γ, β, H, and E are similar to those appearing in FIG. 2.) Spark plugs of two types were prepared; specifically, in one type of spark plug, a spark erosion resistant metal member was provided on the side peripheral surface of the center electrode as shown in FIG. 6; and in a second type of spark plug, the spark erosion resistant metal member was not provided. The distance of the axially frontward end of the spark erosion resistant metal member from the tip of the insulator was set to 0.2 mm. INCONEL 600 (trade name) was used as an electrode base material for the center electrode 2 and the ground electrode 4; a metal of an Ni content of not less than 90% by mass was used as a material for the semi-creepage ground electrode 12; and a pure Pt wire was wound onto the center electrode 2 and laser-beam-welded to the surface of the electrode base material of the center electrode 2 to thereby form the spark erosion resistant metal member.

Figure 11:
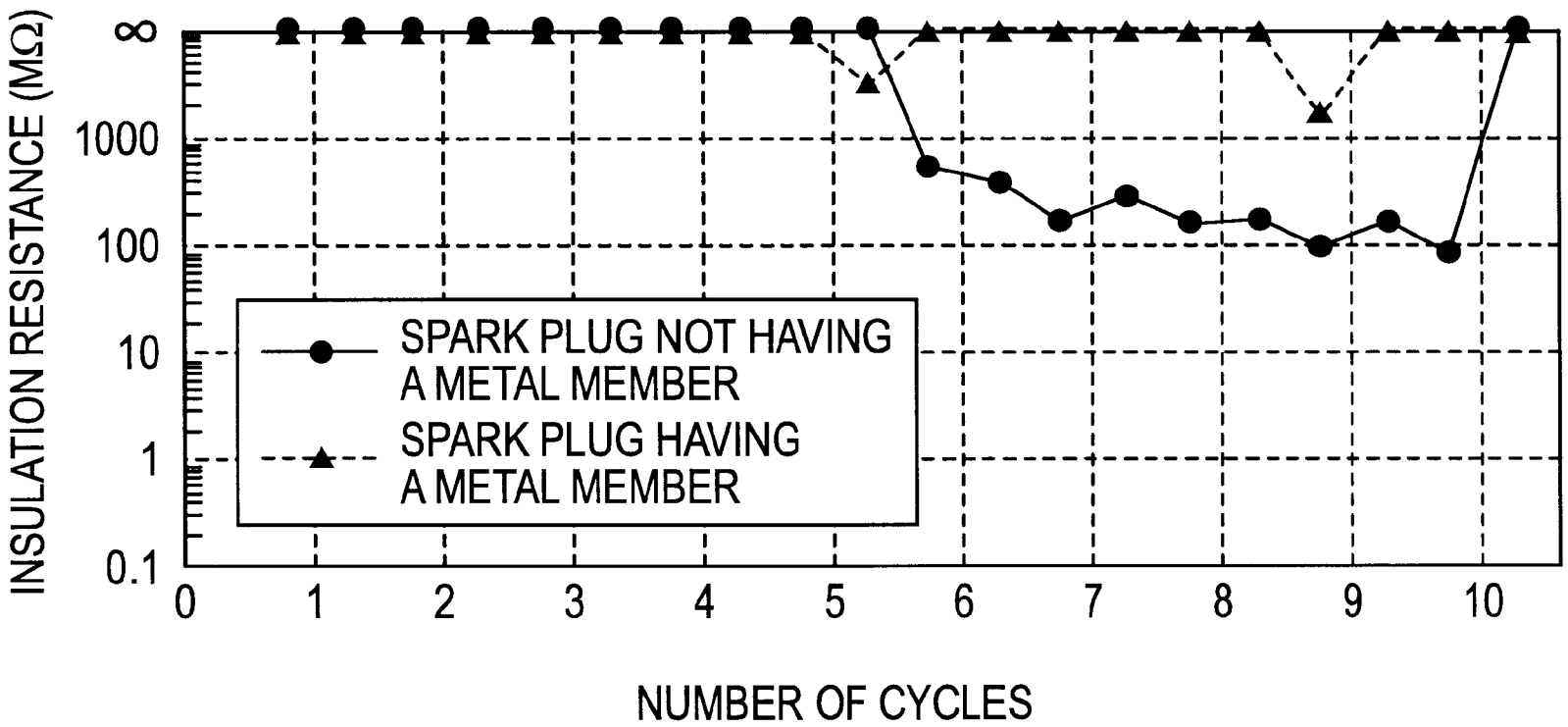
FIG. 11 is a graph showing results of a predelivery fouling test.

The thus-dimensionally-adjusted spark plugs were subjected to a durability test corresponding to a 100,000 km run and then to a predelivery fouling test. The test conditions were as follows. The tests were conducted using a car having a 6-cylinder direct-injection-type internal combustion engine having a piston displacement of 3000 cc, and the spark plugs were mounted on the engine. The car used unleaded high-octane gasoline as fuel and was placed in a low-temperature test room maintained at a temperature of −10° C. In the test room, the car was operated in cycles each consisting of a predetermined operation pattern which is specified in the low-load adaptability test section of JIS D 1606 (1987) and in which short-time operation is performed several times at low speed. In the course of the test cycles, variations in insulation resistance were measured. The graph of FIG. 11 shows the test results. In the graph of FIG. 11, the vertical axis represents insulation resistance (MΩ), and the horizontal axis represents the number of cycles. In the graph, the solid line indicates test results obtained from the spark plug which is not provided with the spark erosion resistant metal member, and the dashed line indicates test results obtained from the spark plug which is provided with the spark erosion resistant metal member.

According to the test results, in the case of the spark plug in which the spark erosion resistant metal member is not provided on the side peripheral surface of the center electrode 2, insulation resistance drops below 1000 MΩ and reaches 100 MΩ before the number of cycles reaches 10. In the case of the spark plug in which the spark erosion resistant metal member is provided, insulation resistance is maintained at 1000 MΩ or higher even after 10 cycles of operation at the predelivery fouling test, indicating that the spark erosion resistant metal member is very effective against carbon fouling. It is considered that in the spark plug in which the spark erosion resistant metal member is not provided, the side peripheral surface of the center electrode is eroded by sparks, with a resultant increase in the distance γ of the semi-creepage insulator gap (γ); thus, the probability increases that, when carbon fouling occurs as a result of progress of cycles, discharge occurs across the main air gap (α) between the parallel electrode and the center electrode, with a resultant impairment in the effect of spark cleaning action. Also, it is considered that in the spark plug in which the spark erosion resistant metal member is provided, the erosion of the side peripheral surface of the center electrode is suppressed. Thus the shape of the side peripheral surface is maintained, thereby maintaining performance intact over a long period of time. This is confirmed from the above-described test results.

It should further be apparent to those skilled in the art that various changes in form and detail of the invention as shown and described above may be made. It is intended that such changes be included within the spirit and scope of the claims appended hereto.

This application is based on Japanese Patent Application No. 2001-051637 field Feb. 27, 2001, the disclosure of which is incorporated herein by reference in its entirety.

What is claimed is:

1. A spark plug (100) comprising an insulator (1) having a center through-hole (1C) formed therein; a center electrode (2) held in the center through-hole, disposed in a tip portion (1D) of said insulator, and having a noble metal chip (105) located at a tip portion thereof; an electrode base material **(2*n*) which forms a surface layer portion of the center electrode; a metallic shell (5) for holding said insulator such that a tip portion of said insulator projects from a tip face (5D) thereof; a parallel ground electrode (11) disposed such that one end thereof is joined to the tip face of said metallic shell while the other end thereof faces a tip face of said center electrode so as to form a main air gap (α); and a plurality of semi-creepage ground electrodes (12) each disposed such that one end thereof is joined to said metallic shell while the other end thereof faces at least either a side peripheral surface of said center electrode or a side peripheral surface of said insulator so as to form a semi-creepage gap (β), said spark plug being characterized in that a tip portion of said center electrode (2) as projected orthogonally on a virtual plane in parallel with an axis of said center electrode includes a tapered portion which is tapered such that the diameter thereof reduces toward the tip face of the center electrode in the axial direction; a convex portion (2*k*) having a convex vertex (P) is formed at an axially intermediate position of the tapered portion such that an outline thereof as viewed on the virtual plane projects radially outward with respect to the axis; an axially measured distance between a convex vertex of the convex portion and a tip of said insulator is less than 0.5 mm; a heat release acceleration metal portion (2*m*)**, higher in thermal conductivity and linear expansion coefficient than the electrode base material, is present at a position located 1.5 mm axially rearward from the convex vertex while being enclosed by the electrode base material; and the electrode base material has a wall thickness (W) of not less than 0.6 mm measured at a position located 1.5 mm axially rearward from the convex vertex.

2. The spark plug as claimed in claim 1, wherein the heat release acceleration metal portion is formed within said center electrode at a position located less than 1.5 mm as measured axially from a tip of the electrode base material located on a spark gap side.

3. The spark plug as claimed in claim 1, comprising a spark erosion resistant metal portion (101), formed of a metal higher in spark erosion resistivity than the electrode base material, said spark erosion resistant metal portion being formed on a surface of said center electrode opposite said semi-creepage ground electrodes, wherein an axially rearward end of the spark erosion resistant metal portion is located axially frontward of the position located 1.5 mm axially rearward from the convex vertex.

4. The spark plug as claimed in claim 3, wherein the spark erosion resistant metal portion comprises a noble metal or an alloy which includes at least one noble metal.

5. The spark plug as claimed in claim 1, wherein the tip face of the insulator, at an opening edge of the center through-hole, is radiused or chamfered.

* * * * *